United States Patent [19]

Wakita et al.

[11] Patent Number: 4,910,111

[45] Date of Patent: Mar. 20, 1990

[54] ELECTROPHOTOGRAPHIC PHOTORECEPTOR COMPRISING AMORPHOUS SILICON LAYER COATED WITH AMORPHOUS INORGANIC MATERIAL

[75] Inventors: Kazuki Wakita, Osaka; Syoichi Nagata; Masatsugu Nakamura, both of Nara; Kunio Ohashi, Nara; Tadashi Tonegawa, Nara; Katsuhiro Nagayama, Nara, all of Japan

[73] Assignee: Sharp Kabushiki Kaisha, Osaka, Japan

[21] Appl. No.: 268;653

[22] Filed: Nov. 8, 1988

Related U.S. Application Data

[63] Continuation of Ser. No. 134,591, Dec. 18, 1987, abandoned, which is a continuation of Ser. No. 945,838, Dec. 23, 1986, abandoned.

[30] Foreign Application Priority Data

Dec. 27, 1986 [JP] Japan ..... 60-297309
Dec. 27, 1986 [JP] Japan ..... 60-297310
Dec. 27, 1986 [JP] Japan ..... 60-297311
Dec. 27, 1986 [JP] Japan ..... 60-297312

[51] Int. Cl.[4] ..... G03G 5/14
[52] U.S. Cl. ..... 430/67
[58] Field of Search ..... 430/66, 67

[56] References Cited

U.S. PATENT DOCUMENTS

| | | | |
|---|---|---|---|
| 4,424,269 | 1/1984 | Sasaki et al. | 430/94 |
| 4,659,639 | 4/1987 | Mizuno et al. | 430/67 X |
| 4,664,999 | 5/1987 | Kakinuma et al. | 430/67 |
| 4,675,265 | 6/1987 | Kazama et al. | 430/67 |

*Primary Examiner*—J. David Welsh
*Attorney, Agent, or Firm*—Flehr, Hohbach, Test, Albritton & Herbert

[57] ABSTRACT

A photoreceptor with a photoconductive layer of amorphous silicon has an overcoating layer to protect the photoconductive layer and to prevent formation of $SiO_x$. The overcoating layer is amorphous $C_{1-x}X_x$, $Ge_{1-x}X_x$, $(BNGe)_{1-x}X_x$ or $(BNC)_{1-x}X_x$ where x is greater than or equal to 0 and smaller than 0.5 and X is H, F or Cl.

3 Claims, 1 Drawing Sheet

ELECTROPHOTOGRAPHIC PHOTORECEPTOR COMPRISING AMORPHOUS SILICON LAYER COATED WITH AMORPHOUS INORGANIC MATERIAL

This is a continuation, of application Ser. No. 134,591 filed Dec. 18, 1987, which is a continuation, of application Ser. No. 945,838 filed Dec. 23, 1986.

BACKGROUND OF THE INVENTION

This invention relates to a photoreceptor used in electrophotography.

In connection with electrophotographic apparatus such as copying machines and document readers, many kinds of materials have been considered for forming a photoconductive layer. Inorganic materials such as Se, CdS and ZnO as well as organic materials such as PVK-TNF have been used previously for this purpose but these previously considered materials generally do not satisfy all the conditions required of a photoreceptor such as properties related to optical sensitivity, spectroscopic sensitivity, signal-to-noise ratio (light resistance/dark resistance), durability and safety to the human body. It has therefore been a common practice to make a compromise to a certain degree regarding certain aspects and make a choice, depending on the individual circumstance under which use is contemplated.

Amorphous silicon, with desirable characteristics such as high optical sensitivity and high durability, has been considered an excellent material. With the conventional photoreceptors of the type having a photoconductive layer of amorphous silicon, however, use is made of a material of amorphous silicon type also for an overcoating layer formed on the surface to protect this photoconductive layer. When ozone is generated by the chargers which are used for charging and erasing, silicon in this overcoating layer reacts with ozone to generate $SiO_x$ on the image forming surface. Since $SiO_x$ has water-absorbing characteristics, electric charges on the surface become diffused easily by absorbed water if humidity is high, causing the image to "run" and thereby adversely affecting the quality of images.

SUMMARY OF THE INVENTION

It is therefore an object o the present invention to provide a photoreceptor with which generation of $SiO_x$ can be prevented on its image forming surface and the image can be prevented from running.

The above and other objects of the present invention are achieved by forming an overcoating layer of amorphous $C_{1-x}X_x$, $Ge_{1-x}X_x$, $(BNGe)_{1-x}X_x$ or $(BNC)_{1-x}X_x$ (where x is greater than or equal to 0 and less than 0.5 and X indicates a third component such as H, F and C1) on the top surface of a photoconductive layer of amorphous silicon so as to prevent formation of $SiO_x$ on the image forming surface. If a photoreceptor is formed as described above, the overcoating layer formed according to the present invention serves to separate ozone, which is generated by the chargers for charging and erasing the image forming surface of the photoreceptor, from silicon in the photoconductive layer. As a result, $SiO_x$ is not generated on the image forming surface and the images can be prevented from running. In summary, the present invention serves to improve the image quality of a photoreceptor and to make amorphous silicon practically usable as photoconductive material.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

Figure 1:
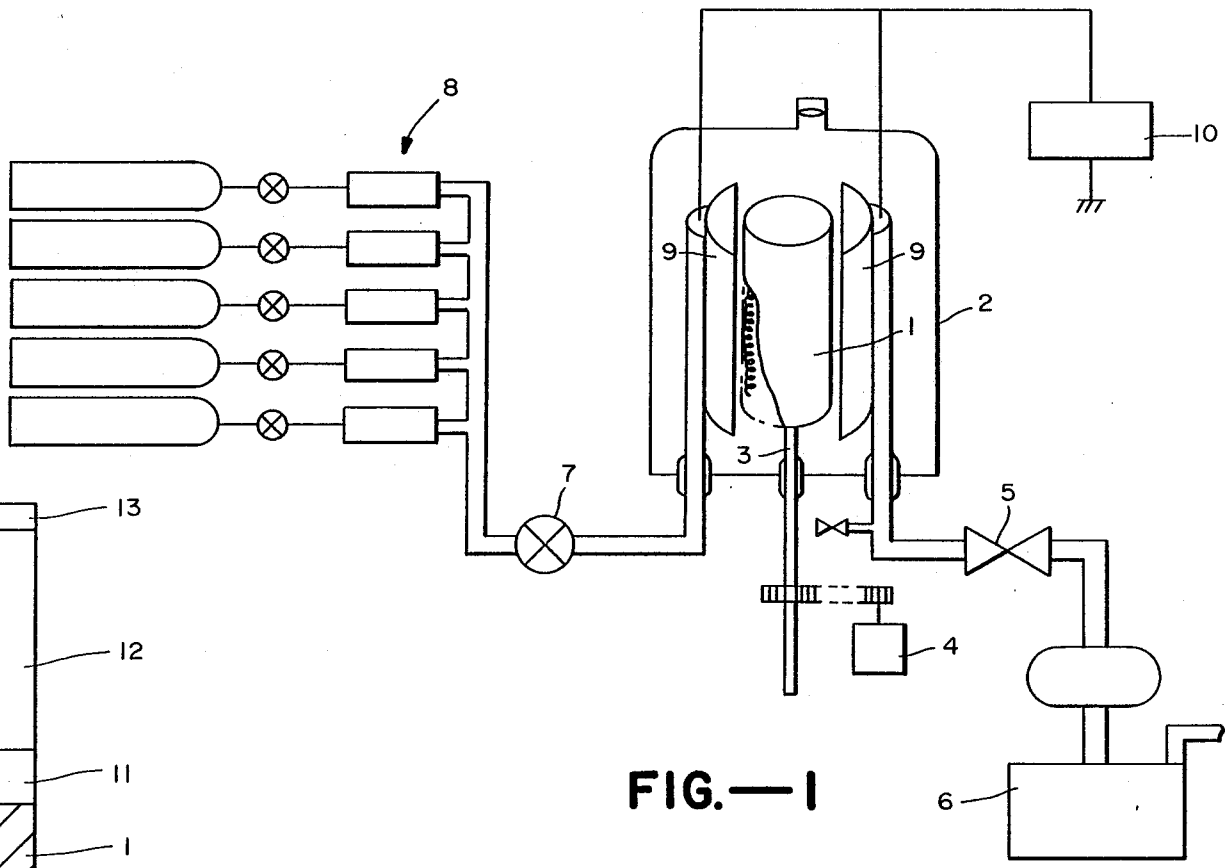
FIG. 1 is a schematic drawing of a device for the formation of an amorphous silicon layer.

An apparatus for forming an amorphous silicon layer is schematically shown in FIG. 1 for the purpose of explaining a method of manufacturing a photoreceptor embodying the present invention. In what follows, a photosensitive drum of the type used in a copying machine is considered with its amorphous layers formed by the glow discharge method.

With reference to FIG. 1, numeral 1 indicates a cylindrical drum of aluminum which serves as the substrate for the photoconductive layer to be formed. After its surface is washed thoroughly, the drum 1 is mounted to a support 3 inside a reaction chamber 2. The support 3 is connected to an external driving means 4 which provides a rotary motion to the drum 1. After the drum 1 is set, an exhaust valve 5 is opened to remove the air inside the reaction chamber 2 by means of a vacuum pump 6. Numeral 7 indicates an auxiliary valve which is opened to introduce into the reaction chamber 2 a reactant gas prepared at a desired mixing ratio by means of a mass flow controller 8. The exhaust valve 5 is adjusted in this process so that pressure is maintained at a predetermined level. After the atmosphere inside the reaction chamber 2 is thus prepared, high frequency power of 13.56 MHz is applied between discharge electrodes 9 from a high frequency power source 10. A glow discharge takes place as a result between the electrodes 9 and an amorphous layer is formed on the surface of the drum 1.

Figure 2:
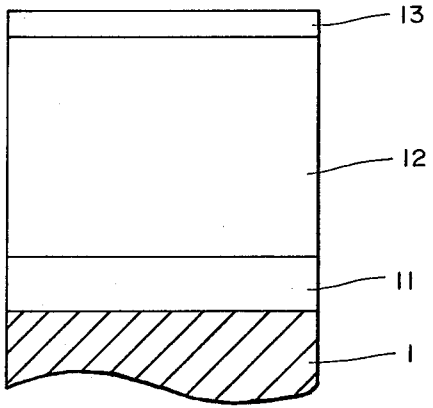
FIG. 2 is a sectional view of a portion of amorphous layers formed by the apparatus of FIG. 1.

According to the present invention, the apparatus shown in FIG. 1 is used to form three amorphous layers as shown in FIG. 2 on the surface of the drum. The first is a blocking layer 11 formed as a foundation layer on the surface of the drum 1 and is made of amorphous silicon. The second is a photoconductive layer 12 for generating and transporting carriers and is also made of amorphous silicon. The third is an overcoating layer 13 for protecting the photoconductive layer 12 and is made of amorphous CH according to one embodiment of the present invention. The overcoating layer 13 is made of amorphous GeH according to another embodiment of the present invention, BNGeH according to still another embodiment of the present invention and BNCH according to a further embodiment of the present invention. Amorphous silicon, amorphous CH, amorphous GeH, amorphous BNGeH and amorphous BNCH of these layers can be prepared by adjusting the composition of the reactant gas as well as its mixing ratio.

Table 1 shows the conditions under which amorphous layers were formed for four photosensitive drums embodying the present invention (Examples 1–4) and one (Example 5) of prior art type for comparison. The first (blocking) and the second (photoconductive) amorphous silicon layers were formed under identical conditions for all examples. The third (overcoating)

layer of amorphous CH of Example 1 was formed by a glow discharge by introducing $CH_4$ gas into the reaction chamber 2. The third layer of amorphous GeH layer of Example 2 was formed by a glow discharge by introducing a mixture of $GeH_4$ and $H_2$ gases into the reaction chamber 2. The third layer of amorphous BNGeH layer of Example 3 was formed by a glow discharge by introducing a mixture of $B_2H_6$, $GeH_4$ and $H_2$ gases into the reaction chamber 2. The third layer of amorphous BNCH of Example 4 was formed by a glow discharge by introducing a mixture of $B_2H_6$, $C_2H_6$ and $N_2$ gases into the reaction chamber 2. Likewise, the third layer of amorphous SiCH of Example 5 was formed by a glow discharge by introducing a mixture of $SiH_4$ and $CH_4$ gases into the reaction chamber 2.

TABLE 1

| Ex. | Amorphous Layer | Flow Rate (SCCM) $SiH_4$ | $B_2H_6$ | $H_2$ | $CH_4$ | $GeH_4$ | $N_2$ | $C_2H_6$ | Power ($W/cm^2$) | Pressure (Torr) | Substrate Temp. (°C.) | Layer Thickness (μm) |
|---|---|---|---|---|---|---|---|---|---|---|---|---|
| 1 | 1 | 300 | 0.1 | 500 | — | — | — | — | 0.3 | 0.5 | 280 | 0.6 |
| | 2 | 300 | 0.001 | 500 | — | — | — | — | 0.3 | 0.5 | 280 | 30 |
| | 3 | — | — | — | 100 | — | — | — | 0.1 | 0.05 | 250 | 0.3 |
| 2 | 1 | 300 | 0.1 | 500 | — | — | — | — | 0.3 | 0.5 | 280 | 0.6 |
| | 2 | 300 | 0.001 | 500 | — | — | — | — | 0.3 | 0.5 | 280 | 30 |
| | 3 | — | — | 500 | — | 300 | — | — | 0.1 | 0.05 | 250 | 0.3 |
| 3 | 1 | 300 | 0.1 | 500 | — | — | — | — | 0.3 | 0.5 | 280 | 0.6 |
| | 2 | 300 | 0.001 | 500 | — | — | — | — | 0.3 | 0.5 | 280 | 30 |
| | 3 | — | 50 | — | — | 50 | 800 | — | 0.1 | 0.05 | 250 | 0.3 |
| 4 | 1 | 300 | 0.1 | 500 | — | — | — | — | 0.3 | 0.5 | 280 | 0.6 |
| | 2 | 300 | 0.001 | 500 | — | — | — | — | 0.3 | 0.5 | 280 | 30 |
| | 3 | — | 50 | — | — | — | 800 | 50 | 0.1 | 0.05 | 250 | 0.3 |
| 5* | 1 | 300 | 0.1 | 500 | — | — | — | — | 0.3 | 0.5 | 280 | 0.6 |
| | 2 | 300 | 0.001 | 500 | — | — | — | — | 0.3 | 0.5 | 280 | 30 |
| | 3 | 10 | — | — | 500 | — | — | — | 0.1 | 0.3 | 250 | 0.2 |

*Prior Art

The photosensitive drums thus prepared were used for copying under different humidity conditions to determine whether images ran (YES) or not (NO). The results are shown in Table 2.

TABLE 2

| Example | Humidity 60% | 70% | 80% | 90% |
|---|---|---|---|---|
| 1,2,3,4 | No | No | No | No |
| 5* | No | Some | Yes | Yes |

*Prior Art

For this experiment, each drum was mounted in a copying machine and was operated under the following conditions after aging by 10,000 sheets: peripheral speed of the drum=254.4 cm/sec, corona current=90 μA, and bias voltage=164V. The initial surface voltage was 500V and the temperature of the drum was 31° C. Table 2 shows that images of high quality could be obtained with photosensitive drums embodying the present invention in the range of humidity between 60% and 90%. With the photosensitive drum of prior art type (Example 5), however, there was no run at humidity 60% but the image quality began to deteriorate as humidity reaches 70% and runs were distinctly visible at humidity thereabove. In summary, it may be concluded that the photosensitive drums of the present invention are capable of preventing runs and serve to improve the quality of produced images.

If the amorphous CH layer of Example 1 is formed with a high frequency power source of 0.5 $W/cm^2$ or over, uniform copy samples cannot be obtained. If such an amorphous CH layer is analyzed by X-ray diffraction, it is found that minute crystalline structure can be observed. It may be concluded from this observation that the overcoating layer 13 must be of amorphous structure containing no minute crystals.

The foregoing description of preferred embodiments of the invention has been presented for purposes of illustration and description. It is not intended to be exhaustive or to limit the invention to the precise form disclosed, and many modifications and variations are possible in light of the above teaching. For example, the amorphous overcoating layer 13 is not limited to CH, GeH, BNGeH or BNCH. Hydrogen in these compounds may be replaced by or Cl, or may be absent. In summary, the overcoating amorphous layer according to the present invention may be $C_{1-x}X_x$, $Ge_{1-x}X_x$, $(BNGe)_{1-x}X_x$ or $(BNC)_{1-x}X_x$ where X is H, F or Cl and x is equal to or greater than 0 and smaller than 0.5.

What is claimed is:

1. In a photoreceptor including a photoconductive layer comprising amorphous silicon, the improvement wherein an overcoating amorphous layer is formed over said amorphous silicon layer said overcoating layer comprising $Ge_{1-x}X_x$ where x is equal to or greater than 0 and smaller than 0.5 and X is an element selected from the group consisting of H, F and Cl.

2. In a photoreceptor including a photoconductive layer comprising amorphous silicon, the improvement wherein an overcoating amorphous layer s formed over said amorphous silicon layer, said overcoating layer comprising $(BNGe)_{1-x}X_x$ where x is equal to or greater than 0 and smaller than 0.5 and X is an element selected from the group consisting of H, F and Cl.

3. In a photoreceptor including a photoconductive layer comprising amorphous silicon, the improvement wherein an overcoating amorphous layer is formed over said amorphous silicon layer, said overcoating layer comprising $(BNC)_{1-x}X_x$ where x is equal to or greater than 0 and smaller than 0.5 and X is an element selected from the group consisting of H, F and Cl.

* * * * *